US006173516B1

(12) United States Patent
Duerrstein

(10) Patent No.: US 6,173,516 B1
(45) Date of Patent: Jan. 16, 2001

(54) COLLAPSIBLE DOUBLE IMAGE POSTER

(76) Inventor: Richard J. Duerrstein, 22261 Kinzie St., Chatsworth, CA (US) 91311

( * ) Notice: Under 35 U.S.C. 154(b), the term of this patent shall be extended for 0 days.

(21) Appl. No.: 09/347,545

(22) Filed: Jul. 6, 1999

(51) Int. Cl.[7] ..... G09F 19/14
(52) U.S. Cl. ..... 40/453; 40/610; 160/370.23
(58) Field of Search ..... 40/453, 603, 610, 40/591, 593; 160/370.23

(56) References Cited

U.S. PATENT DOCUMENTS

| | | | | |
|---|---|---|---|---|
| D. 270,319 | | 8/1983 | Greenberg . | |
| 385,912 | | 7/1888 | Coote . | |
| 3,406,476 | | 10/1968 | Wilcox . | |
| 4,202,396 | * | 5/1980 | Levy | 160/107 |
| 4,233,767 | | 11/1980 | Hryhorczuk . | |
| 4,255,380 | | 3/1981 | Björkland . | |
| 4,422,253 | | 12/1983 | Babberi . | |
| 4,937,960 | | 7/1990 | Otake . | |
| 5,598,650 | | 2/1997 | Brown . | |
| 5,787,956 | * | 8/1998 | Chen | 160/370.23 |

FOREIGN PATENT DOCUMENTS

| | | | | |
|---|---|---|---|---|
| 216315 | * | 5/1924 | (GB) | 40/453 |

* cited by examiner

*Primary Examiner*—Cassandra H. Davis
(74) *Attorney, Agent, or Firm*—Jack C. Munro

(57) ABSTRACT

A collapsible double image poster which utilizes a sheet material base which is formed of a series of pleats. Observing of the front surface of the poster in one oblique direction gives the appearance of a first single intact image and observing of the poster in a second oblique direction, which is at a right angle to the first oblique direction, gives the appearance of a second single intact image. The base is collapsible with the pleats go located in an abutting position. The base is also expandable with the pleats located in an expanded or spaced apart position. When in an expanded position, a crossed elongated member arrangement is mounted on the back side of the poster to retain the poster in the expanded position.

3 Claims, 5 Drawing Sheets

COLLAPSIBLE DOUBLE IMAGE POSTER

BACKGROUND OF THE INVENTION

1) Field of the Invention

This invention relates to display devices and more particularly to a wall mountable display device which provides a pair of separate single intact images which can be observed by looking at the display device from different oblique angles.

2) Description of the Prior Art

Previously, it has been known to construct wall hangings such as posters or pictures which have been created using a corrugated surface which present different information or pictorial displays depending upon the angle from which the poster or picture is viewed. Each image is created by a series of strip-like panels that are mounted parallel to each other. The panels forming one image are arranged perpendicular to a direction of observation which is oblique to the plane of the base. Observing of one image from its observable direction results in only one of the images being visible while the other image is hidden from view. Changing of the observable direction by ninety degrees will result in the second image being observable and the first image then being hidden from view. In other words, the double image poster or picture of the prior art consists of two different images with the panels of each image being placed in alternate spaces between successive folds in a pleated base with the pleats being at an even pitch and mutually parallel.

Such dual image pictures of the prior art have not achieved great popularity. One of the reasons for this lack of popularity is that the poster is constructed not as a poster but is actually a framed picture being of a fixed size. Fixed size pictures are difficult to handle and makes costly the transporting of the framed picture to a gallery or store for marketing. If the picture could be constructed as a poster and was designed to be collapsible so that it could occupy substantially less space facilitating transporting prior to marketing, then possibly the poster could achieve a greater degree of popularity mainly because the poster is able to be sold at a lower cost.

SUMMARY OF THE INVENTION

A collapsible double image poster which is formed of a sheet material base which is of a basic polygonal configuration and has a base plane. Incorporated within the base plane are a series of pleats which are formed in a corrugated manner. Each pleat has a right planer panel and a left planer panel. The base is to be normally constructed of paper and capable of assuming a collapsed position with the pleats located essentially in a narrow or abutting relationship. The base can then be expanded with a pair of dowel rods mounted in a crossed manner on the back side of the base with the ends of the rods located within rod supporting brackets mounted on the base. The base has now assumed an extended position with the right planer panel and left planer panel of each pleat assuming a right angle. Observation of the base at an oblique angle and observing of the right planer panel of each pleat in the straight on direction will result only in the right planer panels being observed and not the left planer panels. Observation at an oblique angle and ninety degrees spaced from the first observation direction will result in observing of only the left planer panels of each pleat and eliminating of the observation of the right planer panels.

The primary objective of the present invention is to construct a piece of art in the form of a poster or picture that includes a double image with each image being observable individually depending upon the direction of observance of the poster.

Another objective of the present invention is to construct a double image poster that can be collapsed facilitating transportability and storage of the poster prior to usage.

Another objective of the present invention is to construct a double image poster which can be easily expanded to its usage position and mounted in that expanded position not requiring any special skill or special tools.

Another objective of the present invention is to construct and cut the paper of the poster in such a way that it forms an extension to allow the finished piece to "float" from the wall.

Another objective of the present invention is to construct a double image poster which can be manufactured at a relatively inexpensive price and thereby sold to the ultimate consumer at an inexpensive price.

DETAILED DESCRIPTION OF THE PREFERRED EMBODIMENT

Figure 1:
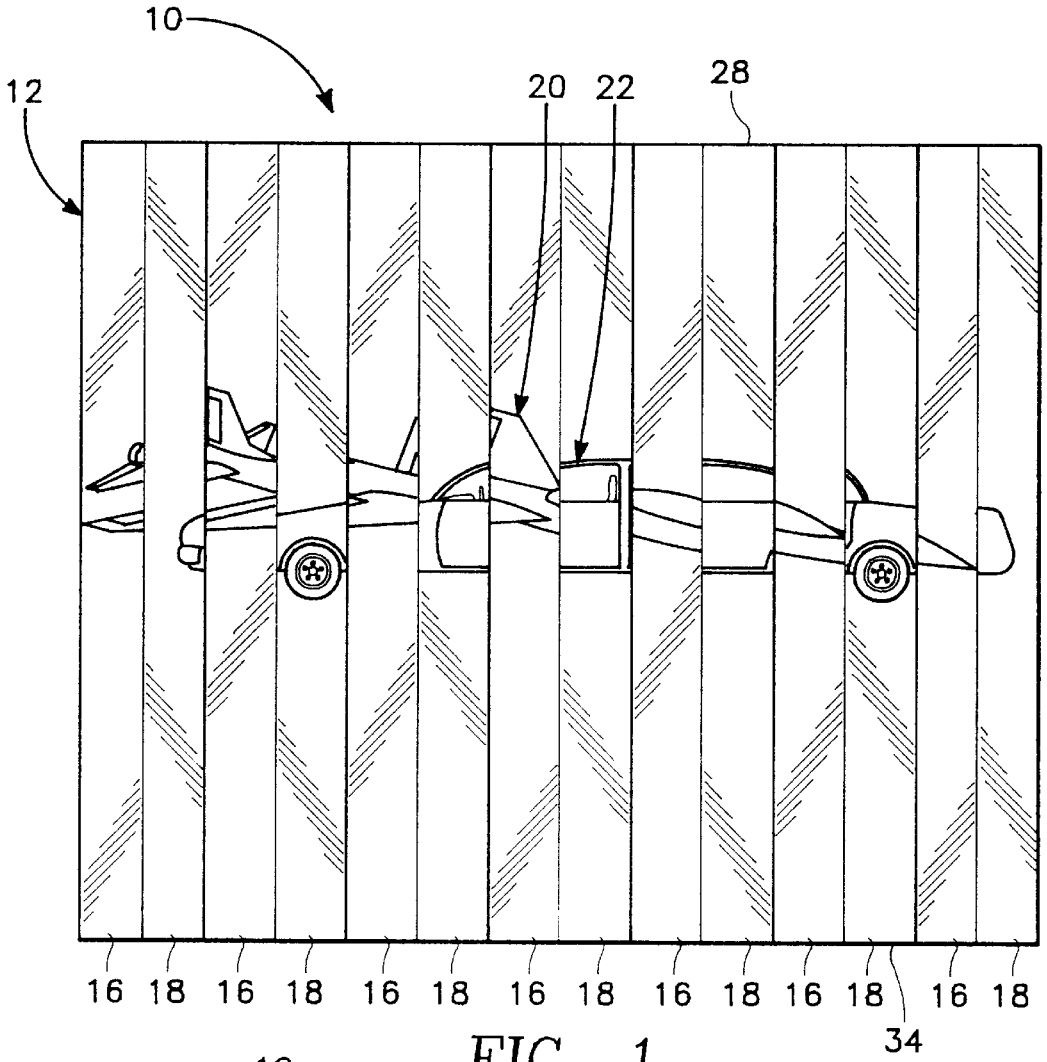
FIG. 1 is a view of the front surface of the double image poster of the present invention with the front view clearly showing both parts of the double image incorporated in conjunction with the poster.
Figure 2:
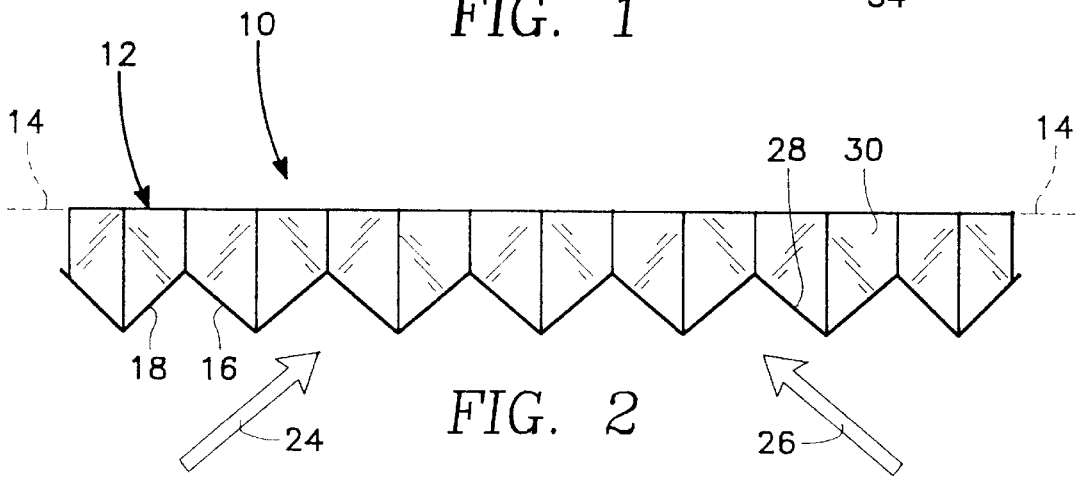
FIG. 2 is a top plan view of the double image poster of FIG. 1 showing the different directions of observation for observing each image on the poster.
Figure 3:
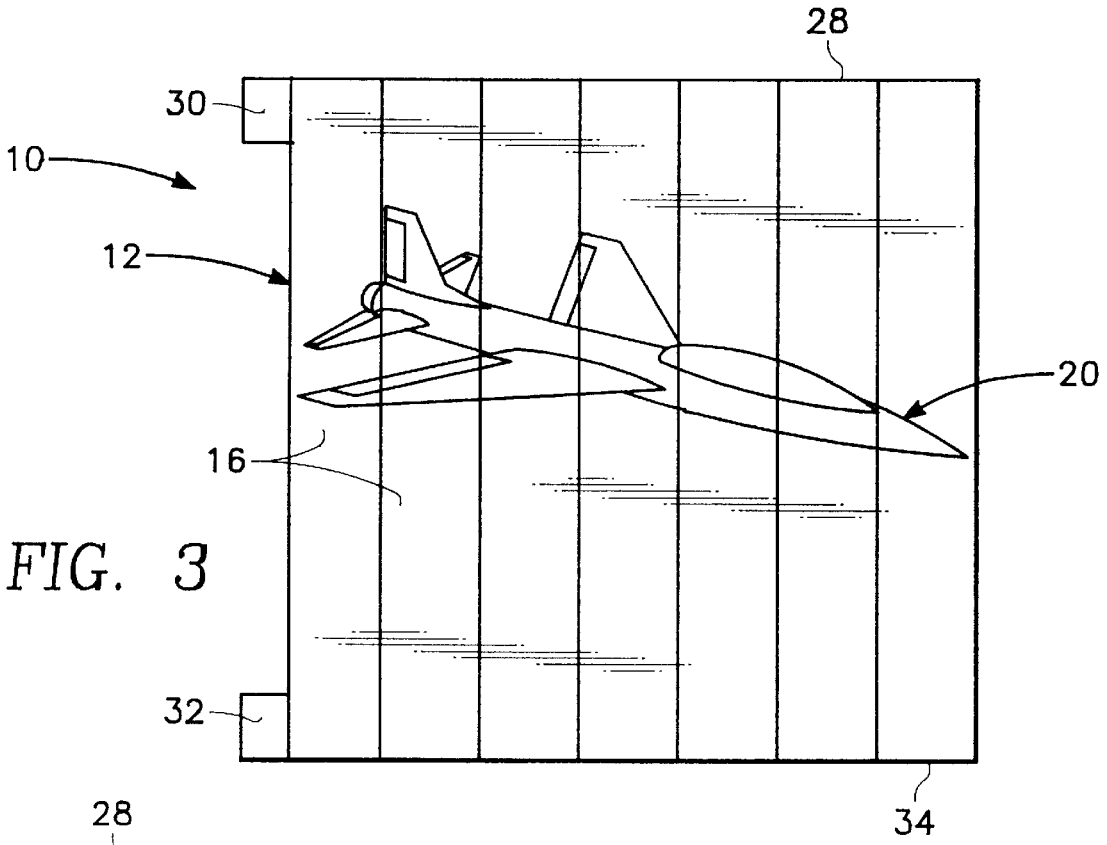
FIG. 3 is the image of the poster that is observed in the direction of the left arrow of FIG. 2.
Figure 4:
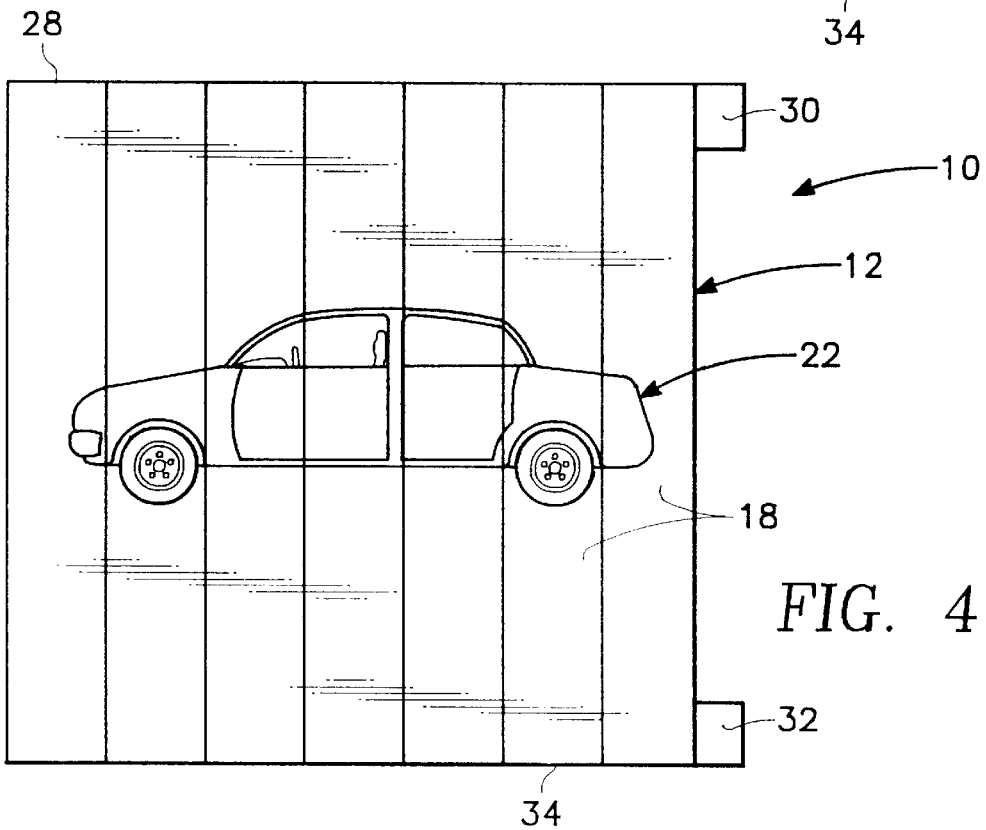
FIG. 4 is the image of the poster that is observed in the direction of the right arrow of FIG. 2.

Referring particularly to the drawings, there is shown the double image poster 10 of this invention which is composed primarily of a sheet material planer base 12. Normal material of construction of the planer base 12 would be paper. However, it is considered to be within the scope of this invention that other types of sheet material could be utilized such as possibly a thin plastic. The planer base 12 defines a base plane 14. This base plane 14 is the plane that the double image poster 10 occupies when it is in an expanded state as shown in FIGS. 1 and 2. When the double image poster 10 is in the expanded position as shown in FIGS. 1 and 2, the poster 10 is capable of being mounted on a vertical surface such as a wall of a home or building. The structure that accomplishes the hanging of the poster 10 on the wall or building is not shown.

The planer base 12 is formed of a series of pleats or corrugations which are all of the same size. Each pleat includes a left planer panel 16 and a right planer panel 18. Both the left planer panel and the right planer panel are each of a rectangular shape and are each of the same size.

Imprinted, drawn or otherwise inscribed on the front surface of the double image poster 10 is a first image 20 and a second image 22. When observing of the front surface of the poster 10 from a position directly perpendicular to the plane 14, the images 20 and 22 are both shown and appear to be intermingled. However, when observing of the poster 10 in the direction of arrow 24, which is an oblique angle to the poster 10 and is actually about forty-five degrees from the base plane 14, only image 20 can be observed with image 22 being hidden. However, upon observing of the poster 10 in the direction of arrow 26 in FIG. 2, only the image 22 can be observed with image 20 then being hidden. The direction of observance of arrow 26 is ninety degrees from the direction of observance of arrow 24.

Fixedly mounted on the upper edge 28 of the poster 10 is a pleated skirt 30. A similar pleated skirt 32 is mounted at the lower edge 34 of the poster 10. Each of the pleated skirts 30 and 32 extend outwardly from the back side of the poster 10. It is to be understood that the images 20 and 22 are located on the front side of the poster 10. Attached to each of the pleated skirts 30 and 32 at each corner of the planer base 12 is a bracket 36. The bracket 36 comprises a box-like configuration when the double image poster 10 is in the expanded configuration. Each bracket 36 includes a hole 38.

Figure 5:
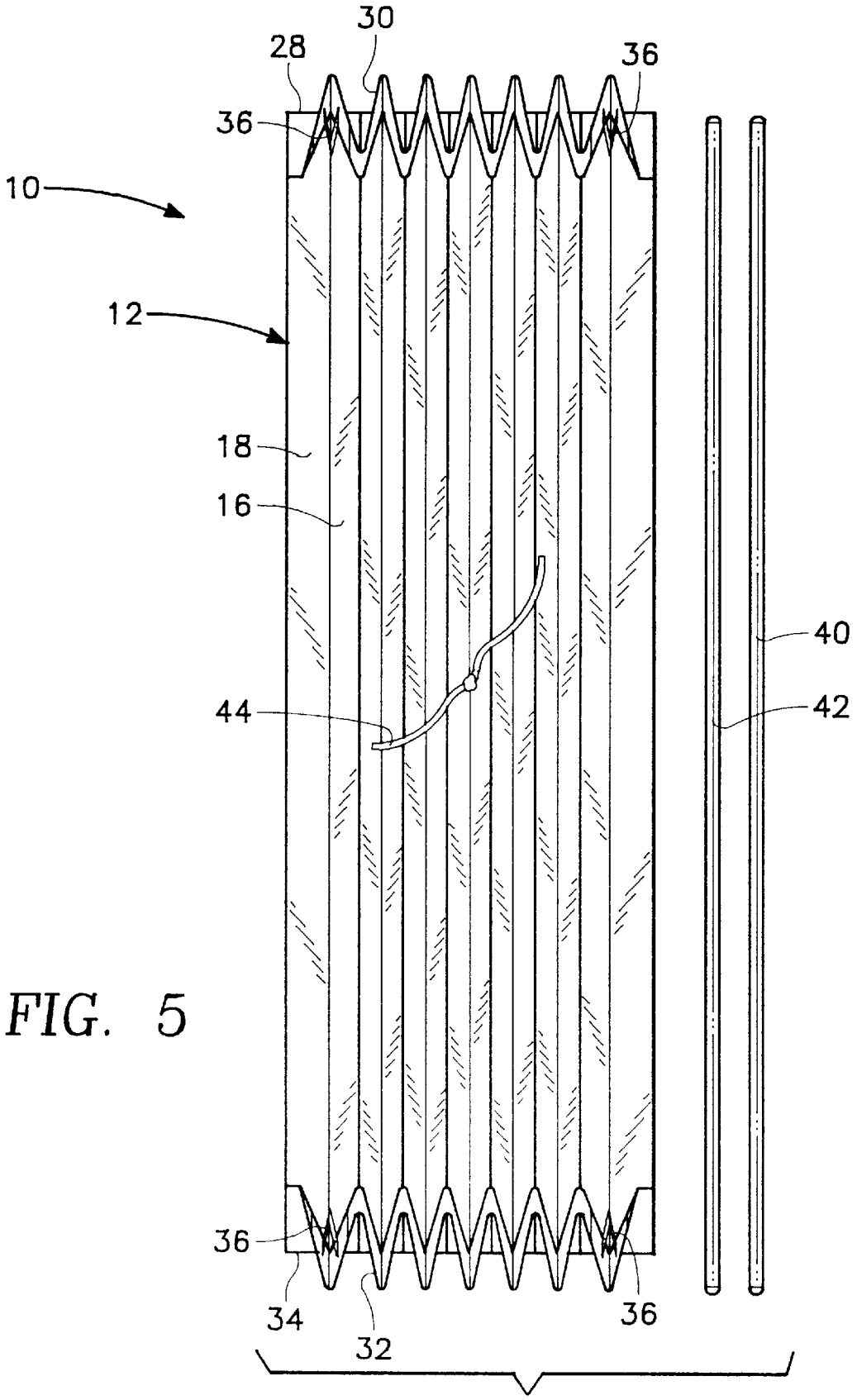
FIG. 5 is a view of the different parts of the poster showing the poster in an almost collapsed position and a view of the back side of the poster.
Figure 6:
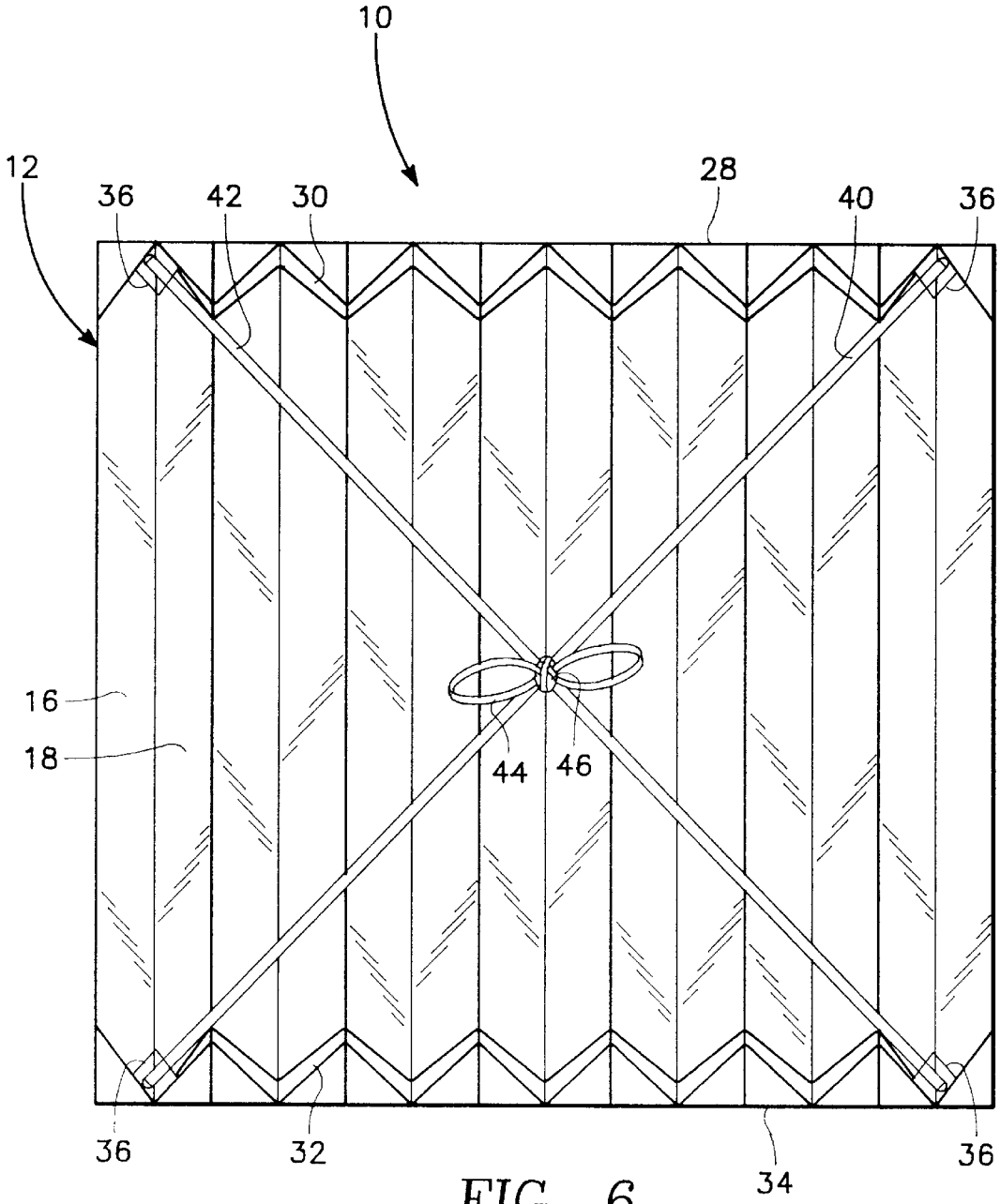
FIG. 6 is a view of the back side of the poster with the poster in its expanded position.
Figure 7:
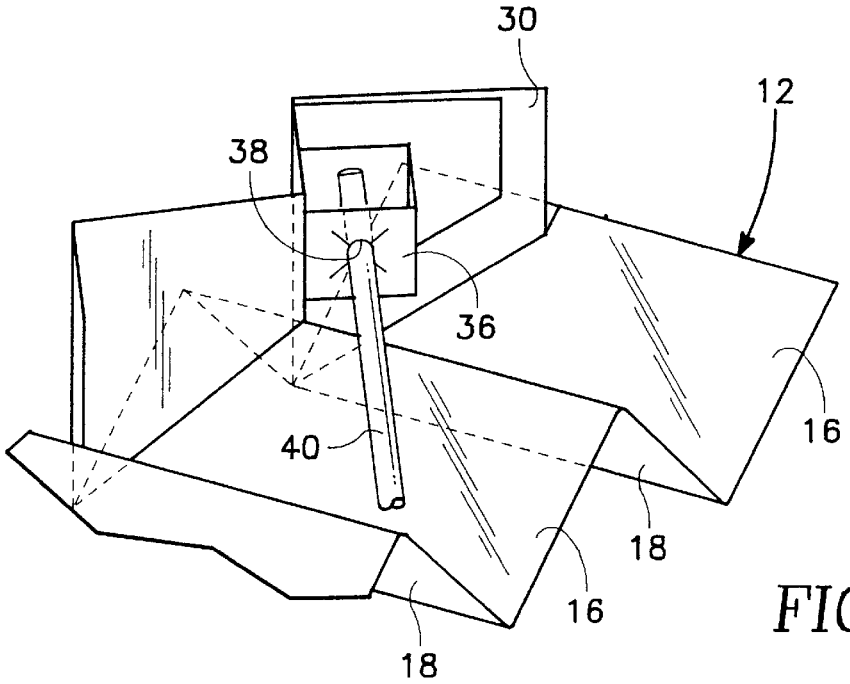
FIG. 7 is an isometric view of one of the rod mounting brackets showing an end of a dowel rod mounted in conjunction with a bracket.
Figure 8:
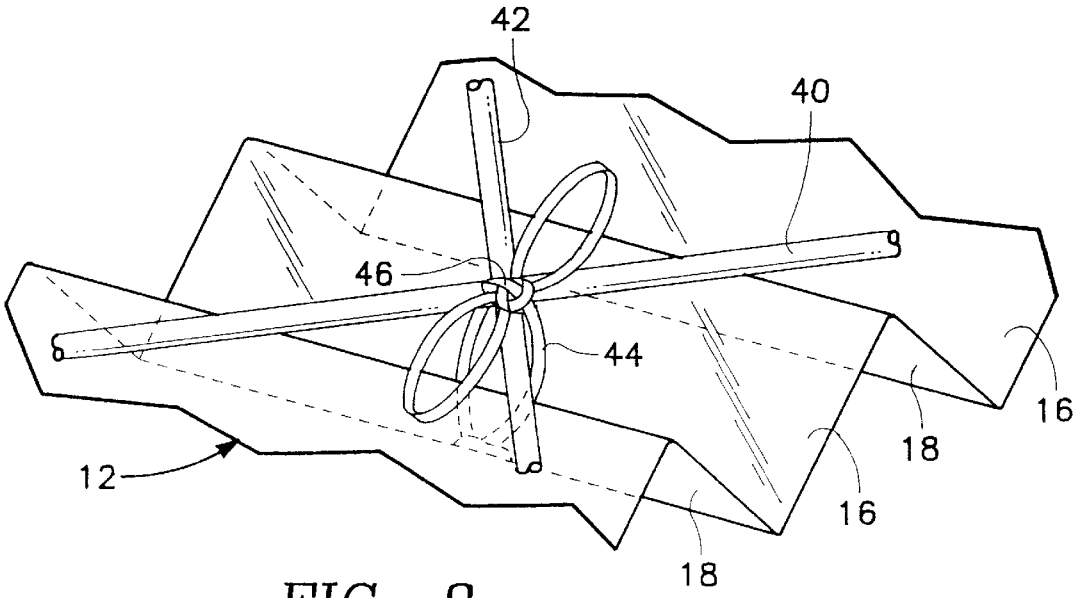
FIG. 8 is an enlarged partial isometric view of the poster showing the securing means for connecting of the poster to the dowel rods.

The double image poster 10 can be moved to a collapsed configuration in which the pleats of the poster 10 are abutting one another. This collapsed position is shown in FIG. 5 although FIG. 5 does not represent the poster 10 in the totally collapsed position as it would make it very difficult to see the different parts of the poster 10. When in the collapsed position, each bracket 36 also folds to an essentially flat configuration. When the poster 10 is moved to the expanded position, one end of an elongated member such as a dowel rod 40 is placed within one of the holes 38 of a bracket 36, as is clearly shown in FIG. 7. The opposite end of the dowel rod 40 is then placed within the diametrically opposite bracket 36. The ends of a similar elongated member such as an identical dowel rod 42 are connected with the remaining pair of diametrically opposite brackets 36 with the result that the dowel rods 40 and 42 are located in a crossed relationship thus referred to as crossed rods. It can thus be seen that the rods 40 and 42 will maintain the planer base 12 of the poster 10 in its expanded configuration which would be its normal usage position. With the back side of the poster 10 placed against a wall, the skirts 30 and 32 will physically abut the surface of the wall and hide from view the rods 40 and 42 as well as the wall mounting device for the poster 10, which is not shown. This hiding from view is completed by the left most panel 16 of the planer base 12 and the right most panel 18 of the planer base 12.

In order to insure that the dowel rods 40 and 42 remain in the connected crossed configuration, and also to keep the planer base 12 from bowing, there is utilized a tie strap 44 which is centrally mounted on the back side of the planer base 12. The tie strap 44 is to be physically tied into a knot 46 at the crossing point of the crossed rods 40 and 42. The tie strap 44 is a securement between the planer base 12 and the dowel rods 40 and 42.

The double image poster 10, when in the collapsed configuration, can be conveniently shipped in a package such as a shipping tube, which is not shown. The shipping package can also be utilized to support the dowel rods 40 and 42. When the user desires to place the poster 10 on a vertical wall, it is only necessary to remove the collapsed planer base 12 from the shipping tube along with the rods 40 and 42 and physically expand the planer base 12 and inserting of the ends of rods 40 and 42 in position with their respective brackets 36 and then tying of the tie strap 44 producing the knot 46. The planer base 12 of the poster 10 can then be mounted directly on a wall surface.

What is claimed is:

1. A collapsible double image poster comprising:

a sheet material base formed in a pleated configuration defining a series of Pleats which are triangular in transverse cross-section, each said pleat having an elongated vertical left planer panel that is rectangular in shape and an elongated vertical right planer panel that is rectangular in shape;

said base being movable between a collapsed position where said pleats are substantially abutting to an extended position where said pleats are spaced apart into a corrugated configuration with said base having a base plane;

means for holding said base in said extended position;

an image being located on said left planer panels and when observed from a first straight on direction, which is oblique to said base plane, gives the appearance of a first single intact image, an image located on said right planer panels and when observed from a second straight on direction, which is substantially Perpendicular to said first straight on direction, gives the appearance of a second single intact image; and said means for holding said base in said extended position comprising at least one elongated member having ends each of which are mounted in retaining brackets mounted on said base.

2. The collapsible double image poster as defined in claim 1 wherein:

there being a pair of said elongated members which are located in a crossed arrangement with an end of each said elongated member being mounted within a retaining bracket that is mounted on said base.

3. The collapsible double image poster as defined in claim 2 wherein:

securing means centrally mounted on said base, said securing means to attach to said elongated members so as to insure that said base is maintained in close proximity to said elongated members.

* * * * *